US005370566A

United States Patent [19]

Mitchell, Jr. et al.

[11] Patent Number: 5,370,566

[45] Date of Patent: Dec. 6, 1994

[54] LIGHTED LIFE JACKET

[76] Inventors: Kenneth C. Mitchell, Jr.; Linda M. Mitchell, both of Rt. 1, Box 4A, Murraysville Rd., Murraysville, W. Va. 26153

[21] Appl. No.: 72,843

[22] Filed: May 26, 1993

[51] Int. Cl.[5] ..... B63C 9/08

[52] U.S. Cl. ..... 441/89; 441/106

[58] Field of Search ..... 441/6, 11, 13, 16, 36, 441/80, 89

[56] References Cited

U.S. PATENT DOCUMENTS 1,174,594 3/1916 McGiff ..... 441/89
3,122,736 2/1964 Weber ..... 441/89
3,621,501 11/1971 Jordan ..... 441/89
4,035,856 7/1977 Oberg ..... 441/89
4,736,205 4/1988 Dodge ..... 441/16
4,779,554 10/1988 Courtney ..... 441/41

*Primary Examiner*—Jesus D. Sotelo
*Attorney, Agent, or Firm*—Gary Alan Culliss

[57] ABSTRACT

A lighted lifejacket for facilitating a location of a user wearing the lifejacket. The lighted lifejacket includes a plurality of lights located around the lifejacket and is provided with a power source in the form of a battery and a switch that allows the lights to either flash or to remain on. The lifejacket further includes a plurality of interchangeable lenses that may be attached to the lights on the lifejacket to selectively change a color of the lights. The lifejacket is also provided with an extensible light mounted in a back area of the lifejacket that is operable to extend above a users head to increase a visibility of the user.

9 Claims, 4 Drawing Sheets

FIG 6
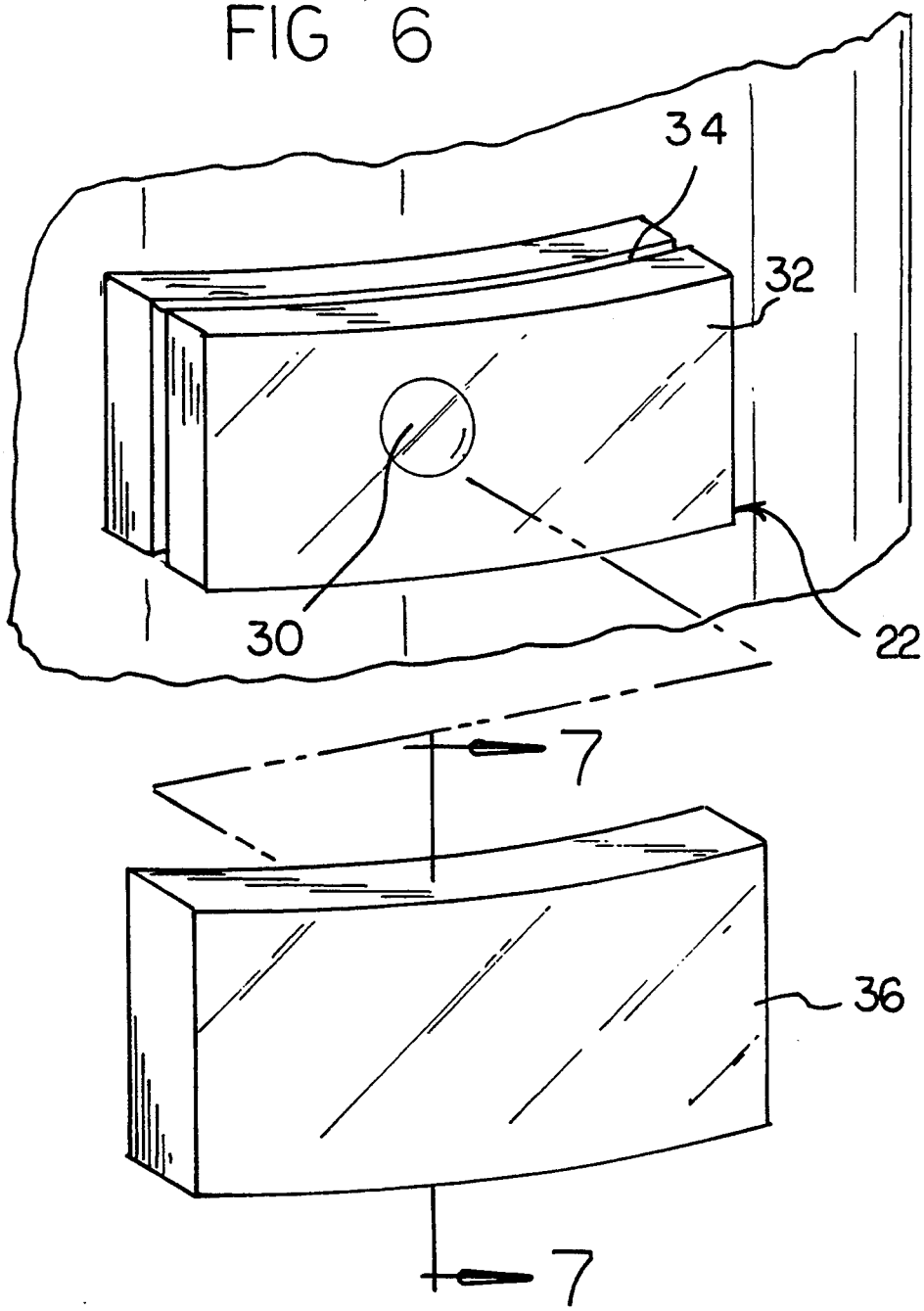
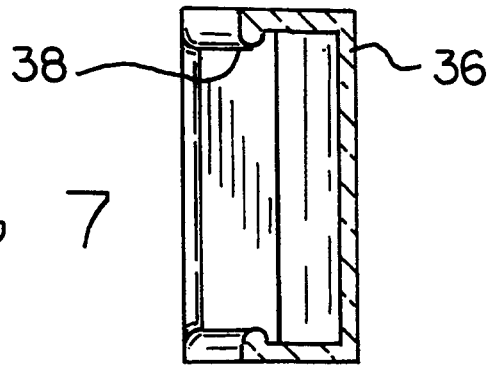
FIG 7

LIGHTED LIFE JACKET

BACKGROUND OF THE INVENTION

1. Field of the Invention

The present invention relates to lifejackets and more particularly pertains to lighted lifejackets which may be utilized to locate a user wearing such a lifejacket.

2. Description of the Prior Art

The use of lifejackets is known in the prior art. More specifically, lifejackets heretofore devised and utilized for the purpose of providing floatation for a user are known to consist basically of familiar, expected and obvious structural configurations, notwithstanding the myriad of designs encompassed by the crowded prior art which have been developed for the fulfillment of countless objectives and requirements.

For example, a personal floatation device which is provided with an inflatable bladder that may be readily inflated to increase the buoyancy of the floatation vest is illustrated in U.S. Pat. No. 3,931,657. The floatation device is provided with a collar through which the bladder extends and serves to cause the user to float face up when the bladder is inflated.

Another patent of interest is U.S. Pat. No. 4,272,857 which discloses a lifejacket with an inflatable body. The lifejacket includes restraints that are dimensioned so that when the inflatable body is deflated, they lie loosely across an opening which does not impede an insertion of the wearers head therethrough.

While these devices fulfill there respective, particular objectives and requirements, the aforementioned patents do not describe a lifejacket which includes light that may be utilized for facilitating a location of a user wearing the lifejacket.

Therefore, it can be appreciated that there exists a continuing need for a new lighted lifejacket which can be utilized for facilitating a location of a user wearing the lifejacket. In this regard, the present invention substantially fulfills this need.

SUMMARY OF THE INVENTION

In view of the foregoing disadvantages inherent in the known types of lifejackets now present in the prior art, the present invention provides a new lighted lifejacket construction wherein the same can be utilized for facilitating a location of a user wearing the lifejacket. As such, the general purpose of the present invention, which will be described subsequently in greater detail, is to provide a new lighted lifejacket apparatus which has many of the advantages of the lifejackets mentioned heretofore and many novel features that result in a lighted lifejacket which is not anticipated, rendered obvious, suggested, or even implied by any of the prior art lifejackets, either alone or in any combination thereof.

To attain this, the present invention essentially comprises a lighted lifejacket for facilitating a location of a user wearing the lifejacket. The lighted lifejacket includes a plurality of lights located around the lifejacket and is provided with a power source in the form of a battery and a switch that allows the lights to either flash or to remain on. The lifejacket further includes a plurality of interchangeable lenses that may be attached to the lights on the lifejacket to selectively change a color of the lights. The lifejacket is also provided with an extensible light mounted in a back area of the lifejacket that is operable to extend above a users head to increase a visibility of the user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lighted lifejacket apparatus which has many of the advantages of the lifejackets mentioned heretofore and many novel features that result in a lighted lifejacket which is not anticipated, rendered obvious, suggested, or even implied by any of the prior art lifejackets, either alone or in any combination thereof.

It is another object of the present invention to provide a new lighted lifejacket which may be easily and efficiently manufactured and marketed.

It is a further object of the present invention to provide a new lighted lifejacket which is of a durable and reliable construction.

An even further object of the present invention is to provide a new lighted lifejacket which is susceptible of a low cost of manufacture with regard to both materials and labor, and which accordingly is then susceptible of low prices of sale to the consuming public, thereby making such lighted lifejackets economically available to the buying public.

Still yet another object of the present invention is to provide a new lighted lifejacket which provides in the apparatuses and methods of the prior art some of the advantages thereof, while simultaneously overcoming some of the disadvantages normally associated therewith.

Still another object of the present invention is to provide a new lighted lifejacket which includes a plurality of lights mounted thereon.

Yet another object of the present invention is to provide a new lighted lifejacket which may be utilized to facilitate a location of a user wearing the lifejacket.

Even still another object of the present invention is to provide a new lighted lifejacket which includes an extensible light mounted on a back area of the lifejacket which may be extended above a users head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 an enlarged perspective view of portion of the present invention.

FIG. 7 is a cross section taken along line 7—7 of FIG. 6.

DESCRIPTION OF THE PREFERRED EMBODIMENT

Figure 1:
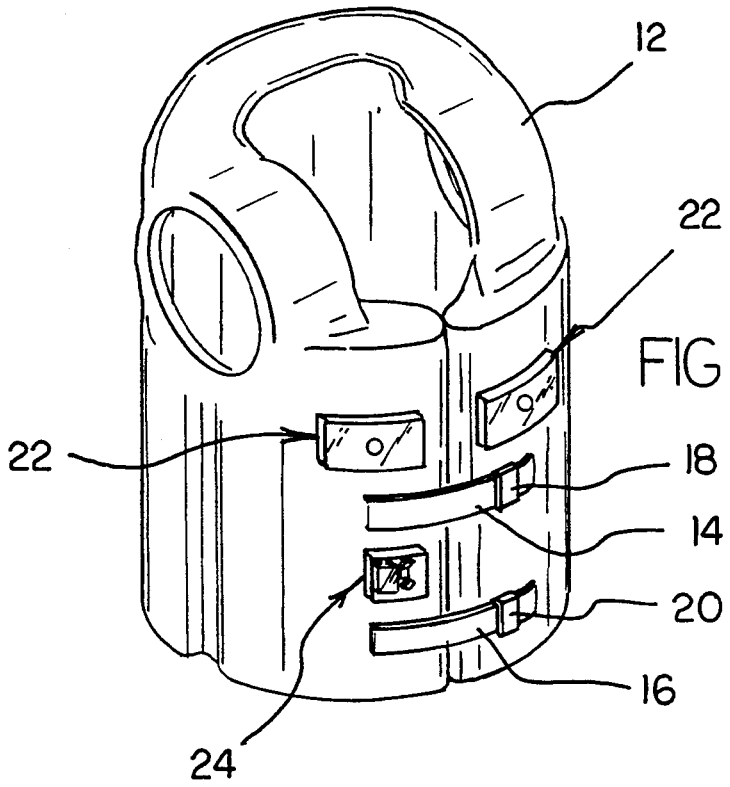
FIG. 1 is a perspective view of a lighted lifejacket comprising the present invention.

With reference now to the drawings, and in particular to FIGS. 1-7 thereof, a new lighted lifejacket embodying the principles and concepts of the present invention and generally designated by the reference numeral 10 will be described.

Figure 2:
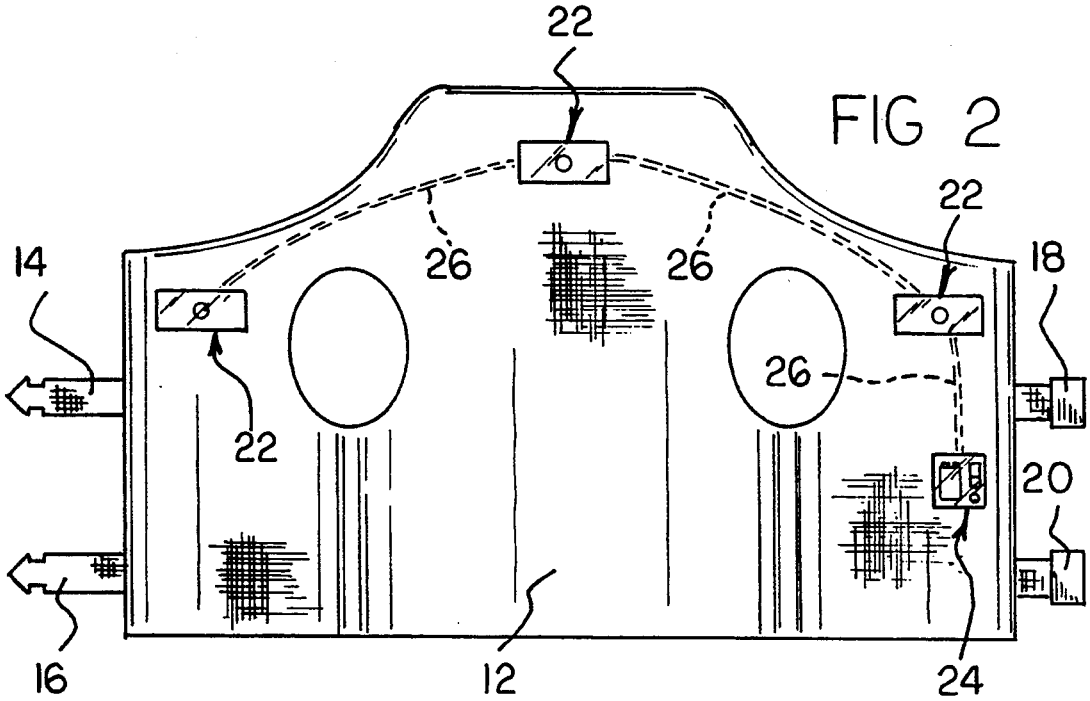
FIG. 2 is a side elevation view of an interior of the present invention.
Figure 3:
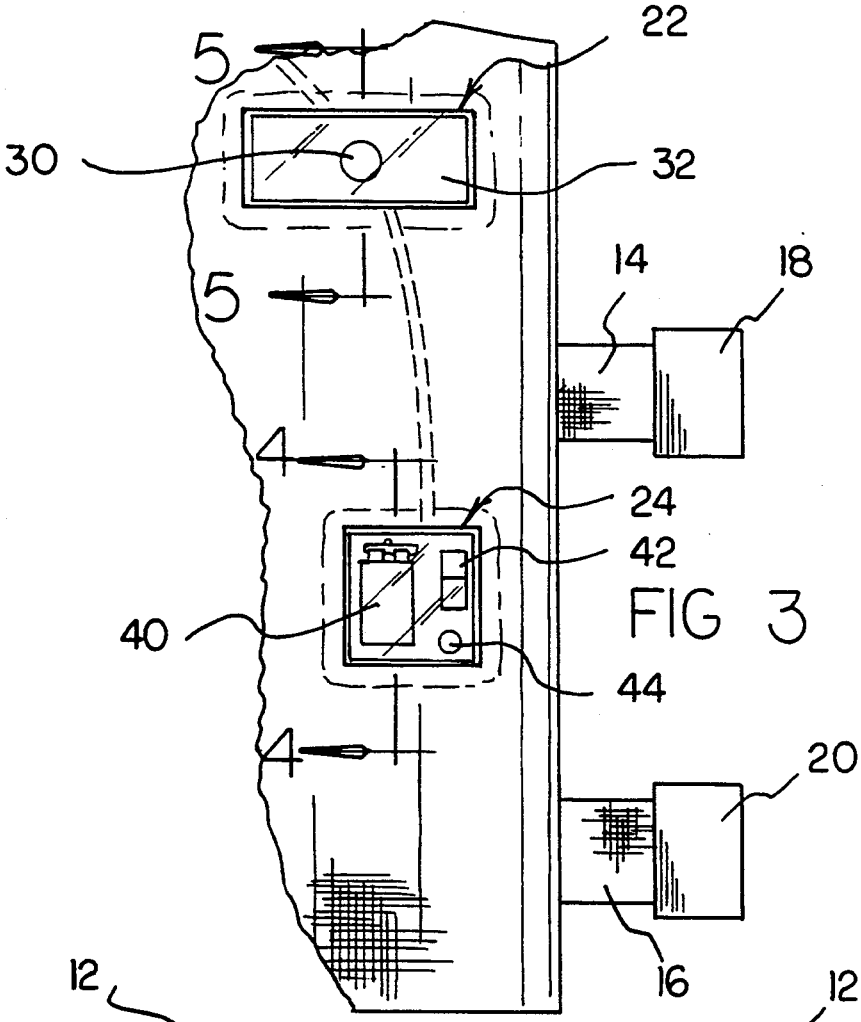
FIG. 3 is an enlarged side elevation view of a portion of the present invention.

More specifically, it will be noted that the lighted lifejacket 10 comprises a flotation vest 12 which may be worn by a user to provide floatation to the user when in water. The floatation vest 12 may be secured around a user in a conventional manner with a pair of straps 14, 16 and a pair of buckles 18, 20, respectively. The vest 12 includes a plurality of light assemblies 22 which are connected to a power source 24 by a plurality of wires 26 that run throughout the floatation vest 12 as seen in FIG. 2. The plurality of light assemblies 22 are positioned upon the flotation vest 12 in such a manner so as to provide two light assemblies in a front area of the floatation vest and one light assembly in a rear area of the floatation vest.

Figure 5:
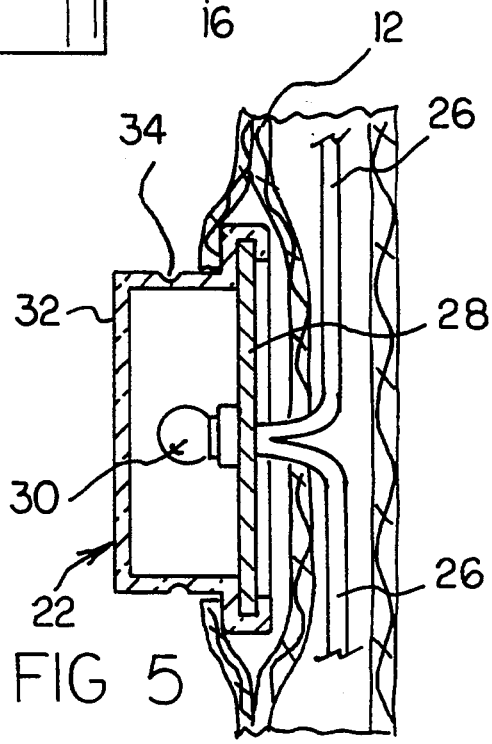
FIG. 5 is a cross section view taken along line 5—5 of FIG. 3.

Each of the plurality of light assemblies 22 is comprised of a light base 28 that supports a bulb 30 thereon, as best illustrated in FIG. 5. The light base 28 is secured to the flotation vest 12 by any conventional means, such as glue and the like. The light base supports a lens 32 which is comprised of a substantially translucent or transparent material so that light from the bulb 30 may pass therethrough.

The bulb is connected by the wires 26 to other light assemblies 22 as well as to the power source 24. Each light assembly 22 further includes a journal 34 located along a perimeter area of the lens 32 to facilitate an attachment of a lens cover 36 thereto, as best seen in FIG. 5 and 7. The lens cover 36 is attachable to the light assembly 22 by a placement of the lens cover over the lens 32. The lens cover 36 includes a ridge 38 that is operable to engage the journal 34 in the lens 32, thereby securing the lens cover thereto. The lens cover 36 is comprised of any substantially transparent or translucent material including those materials which substantially block a portion of the light spectrum so as to cause light from the bulb 30 to appear different colors.

Figure 4:
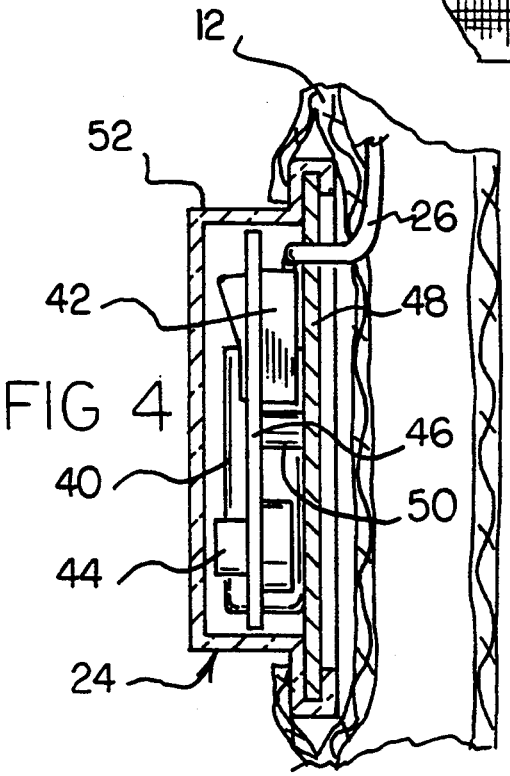
FIG. 4 is a cross section view taken along line 4—4 of FIG. 3.

The power source 24 is secured to the floatation vest 12 in a similar manner as was the light assembly 22. The power source 24 includes a battery 40 which is operable to supply power through the wires 26 to the light assemblies 22. The battery is further connected to a switch 42 which is selectively operable to allow power from the battery 40 to travel through the wires 26 to the light assemblies 22. The battery 40 is further connected to a selector 44 which may be operated by a user to select either a flashing mode of the light assemblies 22 or a sustained mode by utilizing conventional electronics therein. The battery 40, the switch 42, and the selector 44 are all mounted to a support 46 which is secured to a base 48 by a fastener 50, as best seen in FIG. 4. A cover 52 is secured to the base 48 so as to enclose the components therein. The cover 52 is comprised of any substantially flexible and transparent or translucent material that allows a user to visibly operate the switch 42 and the selector 44.

Figure 8:
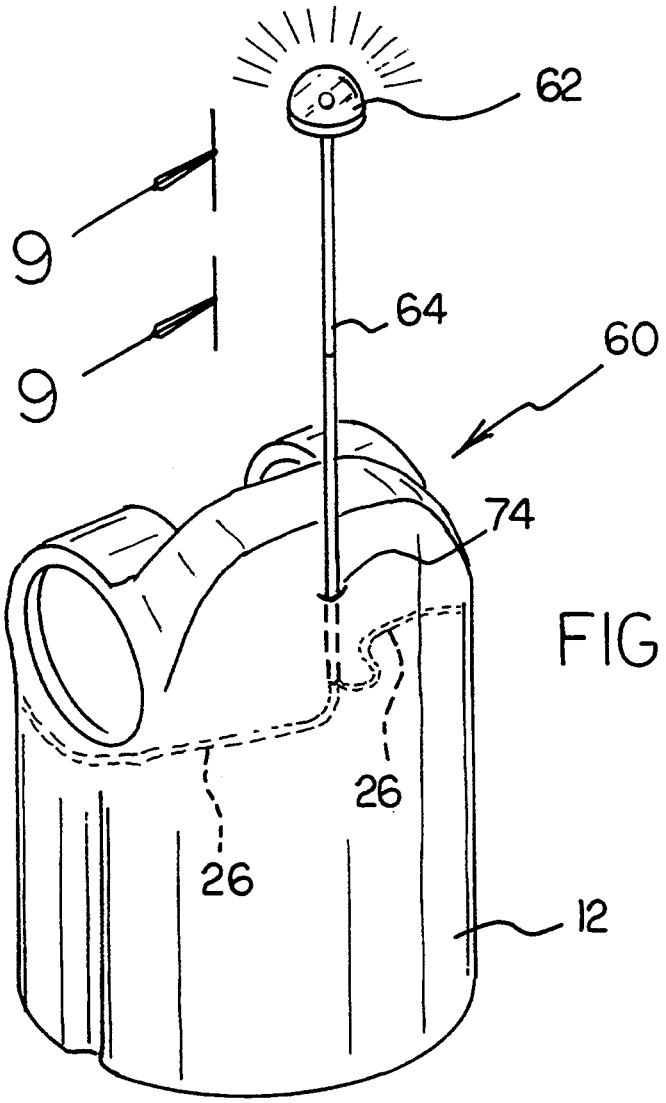
FIG. 8 is a perspective view of a second embodiment of the present invention.
Figure 9:
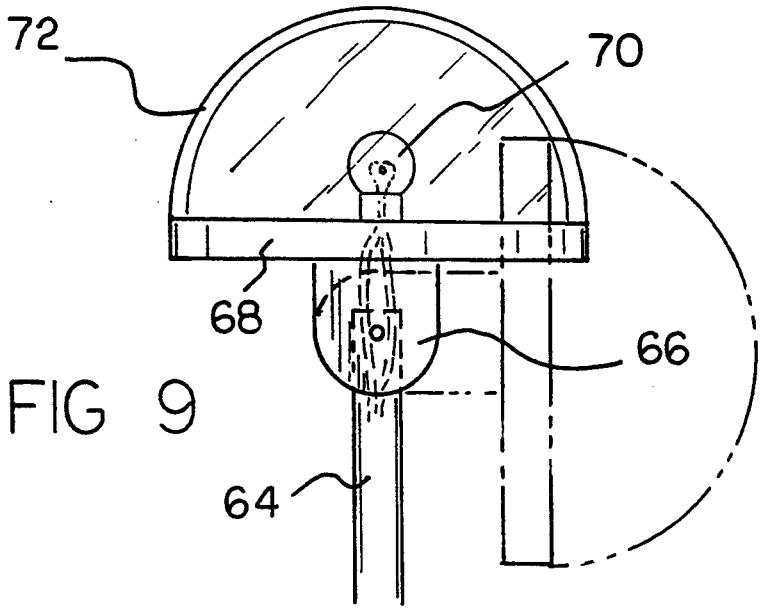
FIG. 9 is an enlarged view as seen along line 9—9 of FIG. 8.

A second embodiment of the present invention as generally designated by the reference numeral 60, which comprises substantially all of the features of the foregoing embodiment 10 and which further comprises a further light assembly 62 will now be described. As best shown in FIGS. 8-9, it can be shown that the further light assembly 62 is supported by a pole 64 which is secured to a back area of the floatation vest 12. The further light assembly 62 is connected to the power source 24 by wires 26, as was done in the first embodiment 10. The further light assembly 62 is supported by the pole 64 upon a hinge 66 that allows the further light assembly to pivot thereon. The further light assembly 62 comprises a base 68 which supports a bulb 70 thereon. The base 68 and the bulb 70 are enclosed by a lens 72 which is substantially hemispherically shaped and which is formed of a substantially translucent or transparent material.

The further light assembly 62 is operable to be extended from an aperture 74 in the floatation vest 12 to a position above that of a user's head as best shown in FIG. 8. The further light assembly 62 is energized by the power supply 24 in a manner substantially similar to that of the plurality of light assemblies 22, as discussed in the previous embodiment 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new lighted life jacket comprising:

a floatation vest having front and back sides and being wearable by a user to provide floatation to said user;

three light assemblies, two of said light assemblies being secured to said front side of said floatation vest, and one of said light assemblies being secured to said back side of said floatation vest;

and, a power source electrically connected to said light assemblies for providing electrical power thereto; wherein said power source comprises: a base, a battery supported by said base; a switch supported by said base and electrically connected to both said battery and said light assemblies to selectively permit energization of said light assemblies by said battery; and a substantially flexible and transparent cover secured to said base for enclosing said battery and said switch to permit an operation of said switch through a deformation of said cover and subsequent movement of said switch by said user.

2. The new lighted life jacket of claim 1, and further comprising a selector in electrical communication with said power source, said selector being selectively operable by said user to provide a pulsed flow of electrical power to said light assemblies.

3. The new lighted life jacket of claim 2, wherein each of said light assemblies comprises a lens having a journal along a perimeter thereof, and a light modifying lens cover placed over said lens, said lens cover having a ridge for engagement to said journal to releasably retain said lens cover over said lens.

4. The new lighted life jacket of claim 3, and further comprising a pole movably attached to said backside of said floatation vest in a vertical orientation, and a further light assembly pivotally mounted on said pole and electrically connected to said power source.

5. The new lighted life jacket of claim 4, wherein each of said light assemblies is substantially rectangular in shape.

6. The new lighted life jacket of claim 5, wherein said light assemblies and said power source are partially embedded within said floatation vest.

7. The new lighted life jacket of claim 6, wherein said power source is electrically connected to said light assemblies by a plurality of wires, said wires being positioned within said floatation vest.

8. The new lighted life jacket of claim 7, wherein said further light assembly is substantially hemispherically shaped.

9. A new lighted life jacket comprising:

a floatation vest having front and back sides and being wearable by a user to provide floatation to said user;

three substantially rectangular light assemblies partially embedded within said floatation vest, two of said light assemblies being positioned on said front side of said floatation vest, and one of said light assemblies being positioned on said back side of said floatation vest, each of said light assemblies comprising a lens having a journal along a perimeter thereof, and a light modifying lens cover placed over said lens, said lens cover having a ridge for engagement to said journal to releasably retain said lens cover over said lens;

a power source partially embedded within said floatation vest and electrically connected by a plurality of wires positioned within said floatation vest to said light assemblies, said power source comprising a base; a battery supported by said base; a switch supported by said base and electrically connected to both said battery and said light assemblies to selectively permit energization of said light assemblies by said battery; and, a substantially flexible and transparent cover secured to said base for enclosing said battery and said switch to permit an operation of said switch through a deformation of said cover and subsequent movement of said switch by said user;

a pole movably attached to said backside of said floatation vest in a vertical orientation, and a substantially hemispherically shaped further light assembly pivotally mounted on said pole and electrically connected to said power source;

and, a selector in electrical communication with said power source, said selector being selectively operable by said user to provide a pulsed flow of electrical power to said light assemblies and said further light assembly.

* * * * *